US011810501B2

(12) United States Patent
Hörner et al.

(10) Patent No.: US 11,810,501 B2
(45) Date of Patent: Nov. 7, 2023

(54) IMAGE ELEMENT AND METHOD FOR OPERATING AN IMAGE ELEMENT

(71) Applicant: ams-OSRAM International GmbH, Regensburg (DE)

(72) Inventors: Patrick Hörner, Regensburg (DE); Igor Stanke, Regensburg (DE)

(73) Assignee: AMS-OSRAM INTERNATIONAL GMBH, Regensburg (DE)

( * ) Notice: Subject to any disclaimer, the term of this patent is extended or adjusted under 35 U.S.C. 154(b) by 0 days.

(21) Appl. No.: 17/918,301

(22) PCT Filed: Apr. 8, 2021

(86) PCT No.: PCT/EP2021/059131
§ 371 (c)(1),
(2) Date: Oct. 11, 2022

(87) PCT Pub. No.: WO2021/209302
PCT Pub. Date: Oct. 21, 2021

(65) Prior Publication Data

US 2023/0146320 A1 May 11, 2023

(30) Foreign Application Priority Data

Apr. 14, 2020 (DE) ..... 102020204708.1

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01);
(Continued)

(58) Field of Classification Search
CPC ..... G09G 3/32; G09G 2300/0426; G09G 2300/0819; G09G 2300/0852;
(Continued)

(56) References Cited

U.S. PATENT DOCUMENTS 10,395,589 B1 8/2019 Vahid Far et al.
2003/0090447 A1 5/2003 Kimura
(Continued)

FOREIGN PATENT DOCUMENTS

EP 1598938 A1 10/2013
EP 3389037 A1 10/2018
EP 3557569 A1 10/2019

OTHER PUBLICATIONS

Kim et al., "PWM Pixel Circuit with LTPS TFTs for Micro-LED Displays", SID 2019 DIGEST, 2019, pp. 192-195.
(Continued)

*Primary Examiner* — Andrew Sasinowski
(74) *Attorney, Agent, or Firm* — MH2 TECHNOLOGY LAW GROUP LLP

(57) ABSTRACT

An image element is disclosed having first and second supply terminals, a light emitting semiconductor component, a driver circuit comprising a driver transistor, a storage capacitor, and a switching transistor, and a trigger circuit comprising an output transistor and a control capacitor. The light emitting semiconductor component and the driver transistor are arranged in series with each other and between the first supply terminal and the second supply terminal. A first electrode of the storage capacitor is coupled to a control terminal of the driver transistor. The switching transistor is configured to switch on and off a current flow through the light emitting semiconductor component. A first electrode of the control capacitor is connected to a control terminal of the output transistor. A first terminal of the output transistor is connected to a control terminal of the switching transistor. Furthermore, a method for operating an image element, in particular such an image element, is disclosed.

17 Claims, 11 Drawing Sheets

(52) U.S. Cl.
CPC . *G09G 2300/0852* (2013.01); *G09G 2310/00* (2013.01); *G09G 2320/0633* (2013.01); *G09G 2330/028* (2013.01)

(58) Field of Classification Search
CPC ..... G09G 2310/08; G09G 2320/0633; G09G 2330/028; G09G 2300/0861; G09G 2320/0238; G09G 2320/064; G09G 2330/023; G09G 3/2014; G09G 3/3233; H05B 45/325; H05B 45/44; H05B 45/10
See application file for complete search history.

(56) References Cited

U.S. PATENT DOCUMENTS

| | | | | |
|---|---|---|---|---|
| 2004/0095298 | A1 | 5/2004 | Miyazawa | |
| 2005/0275647 | A1 | 12/2005 | Numao | |
| 2006/0279313 | A1* | 12/2006 | Fujita | G09G 3/006 324/760.01 |
| 2011/0186852 | A1 | 8/2011 | Kimura et al. | |
| 2013/0162305 | A1 | 6/2013 | Watanabe | |
| 2014/0126261 | A1* | 5/2014 | Newman, Jr. | H05B 39/04 363/128 |
| 2016/0143099 | A1* | 5/2016 | Ding | H05B 45/46 315/122 |
| 2019/0019446 | A1* | 1/2019 | Zhang | G09G 3/32 |
| 2019/0306945 | A1 | 10/2019 | Valentine | |

OTHER PUBLICATIONS

Müller, Uta, International Search Report (with English Translation) and Written Opinion in corresponding International Application No. PCT/EP2021/059131 dated Jul. 2, 2021, 16 pages.

* cited by examiner

IMAGE ELEMENT AND METHOD FOR OPERATING AN IMAGE ELEMENT

CROSS-REFERENCE TO RELATED APPLICATIONS

This patent application is a national stage entry from International Application No. PCT/EP2021/059131, filed on Apr. 8, 2021, published as International Publication No. WO 2021/209302 A1 on Oct. 21, 2021, and claims priority to German Patent Application No. 10 2020 204 708.1, filed Apr. 14, 2020, the entire contents of all of which are incorporated by reference herein.

FIELD OF THE INVENTION

An image element and a method for operating an image element are specified.

BACKGROUND OF THE INVENTION

The image element comprises a light emitting semiconductor component, which can be realized as a light emitting diode, for example, and a driver circuit, which comprises a driver transistor, for example. The driver circuit is used to power the light emitting semiconductor component. A brightness of the image element depends on a value of a current flow through the light emitting semiconductor component. However, since a color location of a light emitting semiconductor component often also depends on the value of the current flow, a change in the value of the current flow may result not only in a change in brightness but also in a change in color location.

One object is to specify an image element and a method for operating an image element in which a color location is as constant as possible.

These objects are solved by the image element and the method for operating an image element according to the independent claims. Further configurations of the image element or the method for operating an image element are the subject of the dependent claims.

SUMMARY OF THE INVENTION

In at least one embodiment, the image element comprises first and second supply terminals, a light emitting semiconductor component, a driver circuit comprising a driver transistor, a storage capacitor, and a switching transistor, and a trigger circuit comprising an output transistor and a control capacitor. The light emitting semiconductor component and the driver transistor are arranged in series with each other and between the first supply terminal and the second supply terminal. A first electrode of the storage capacitor is coupled to a control terminal of the driver transistor. The switching transistor is configured to turn on and off a current flow through the light emitting semiconductor component. A first electrode of the control capacitor is coupled to a control terminal of the output transistor. A first terminal of the output transistor is connected to a control terminal of the switching transistor.

In particular, a current setting voltage can be supplied to the storage capacitor, which is stored by the storage capacitor and sets a value of the current flow through the driver transistor and thus also through the light emitting semiconductor component. Further, a trigger setting voltage can be supplied to the control capacitor, such that a capacitor voltage dropping across the control capacitor is thus set at a first time. An output signal can be tapped at the output transistor. After the trigger setting voltage is supplied, the capacitor voltage decreases such that the output signal also changes and the switching transistor either interrupts or enables current flow through the light emitting semiconductor component. Thus, a brightness of the image element is a function of the value of the current flow as well as a time duration of the current flow. Advantageously, a color location of the image element is approximately constant since the light emitting semiconductor component is either in an off state or in a constant current flow state.

According to at least one embodiment of the image element, a second electrode of the control capacitor is coupled to the first supply terminal. A second terminal of the output transistor is coupled to the first supply terminal.

Advantageously, the control capacitor couples the control terminal of the output transistor to the second terminal of the output transistor. Thus, a capacitor voltage tappable across the control capacitor is identical to a voltage tappable between the control terminal of the output transistor and the second terminal of the output transistor. The capacitor voltage is a function of the trigger setting voltage.

According to at least one embodiment of the image element, the trigger circuit comprises an output resistor coupled to the first terminal of the output transistor and to the second supply terminal.

For example, a series circuit comprising the output resistor and the output transistor couples the first supply terminal to the second supply terminal. The output signal can thus be tapped at the first terminal of the output transistor, which can be fed to the control terminal of the switching transistor. Advantageously, the output transistor and the output resistor form a drain circuit, for example.

According to at least one embodiment of the image element, the control capacitor is self-discharging. Thus, the capacitor voltage that can be tapped at the control capacitor changes with time. An absolute value of the capacitor voltage decreases.

According to at least one alternative embodiment of the image element, the trigger circuit comprises a control resistor coupled to the first and to the second electrode of the control capacitor. Advantageously, by means of the control resistor a value of the current flow for discharging the control capacitor can be adjusted.

According to at least one embodiment, the image element comprises a control transistor having a first terminal coupled to a control signal input of the image element, a second terminal coupled to the first electrode of the control capacitor, and a control terminal coupled to a selection input of the image element.

For example, by means of the control transistor, the trigger setting voltage can be supplied to the control capacitor at a time when the control transistor is switched on by means of a selection signal. The selection signal is supplied to the control terminal of the control transistor.

According to at least one embodiment, the image element comprises a selection transistor having a first terminal coupled to a signal input of the image element, a second terminal coupled to the first electrode of the storage capacitor, and a control terminal coupled to the selection input of the image element.

Advantageously, a current setting voltage can be supplied to the storage capacitor via the selection transistor at a time when the selection transistor is conducting. In at least one embodiment, the selection signal can be supplied to both the control transistor and the selection transistor. Thus, the control transistor and the selection transistor are simultaneously switched to conductive and subsequently both switched to non-conductive.

According to at least one alternative embodiment of the image element, the selection transistor comprises a first terminal coupled to the control signal input of the image element, a second terminal coupled to the first electrode of the storage capacitor, and a control terminal coupled to a further selection input of the image element.

Advantageously, the current setting voltage can be fed to the storage capacitor by means of the selection transistor. The current setting voltage is applied to the control signal input of the image element at a time offset from the trigger setting voltage. A further selection signal can be fed to the further control input. The selection signal and the further selection signal set the control transistor and the selection transistor to a conductive state at different times. Thus, the image element may have either two signal inputs and one control input or two control inputs and one signal input. The control transistor and the selection transistor form a multiplexer.

According to at least one embodiment of the image element, a first terminal of the driver transistor is coupled to the first supply terminal. A second electrode of the storage capacitor is coupled to the first supply terminal. The light emitting semiconductor component is coupled to the second terminal of the driver transistor and to the second supply terminal.

Advantageously, the storage capacitor couples the control terminal of the driver transistor to the first terminal of the driver transistor. Thus, a storage voltage dropped across the storage capacitor is identical to a voltage dropped between the control terminal of the driver transistor and the first terminal of the driver transistor. The storage voltage is a function of the current setting voltage. For example, the first terminal of the driver transistor may be directly and immediately connected to the first supply terminal. Similarly, the second electrode of the storage capacitor may be directly and immediately connected to the first supply terminal. Further, one terminal of the light emitting semiconductor component may be directly and immediately connected to the second terminal of the driver transistor, and another terminal of the light emitting semiconductor component may be directly and immediately connected to the second supply terminal.

According to at least one embodiment of the image element, the switching transistor couples the first electrode of the storage capacitor to the first supply terminal.

Thus, for example, the switching transistor is connected to the first and second electrodes of the storage capacitor. If the switching transistor is switched to conductive, for example by the output signal of the output transistor, the two electrodes of the storage capacitor are short-circuited and the driver transistor is switched to a non-conductive state, for example.

According to at least one embodiment of the image element, the switching transistor is arranged in series with the light emitting semiconductor component and the driver transistor, such that the light emitting semiconductor component, the switching transistor, and the driver transistor are arranged between the first and second supply terminals.

Advantageously, the switching transistor is located in a current path between the first and second supply terminals. The current path supplies the light emitting semiconductor component. Thus, when the switching transistor is placed in a non-conducting state, current flow through the light emitting semiconductor component is interrupted.

According to at least one embodiment of the image element, the driver transistor, the switching transistor, and the output transistor are produced as thin film transistors.

Advantageously, the thin film transistors can be produced on a substrate, for example also on a transparent substrate. Advantageously, the light emitting semiconductor component can also be applied to the substrate of the thin film transistors. For example, not only the transistors but also the capacitors, such as the control capacitor and the storage capacitor, and any resistors are arranged on the substrate. The substrate may be realized from an organic material, such as a polyamide film.

According to at least one embodiment of the image element, the driver transistor, the switching transistor and the output transistor are realized as n-channel field effect transistors.

According to at least one alternative embodiment of the image element, the driver transistor, the switching transistor and the output transistor are realized as p-channel field effect transistors.

Advantageously, the image element is realized in such a way that transistors of a single channel type are sufficient for operation. The image element thus has transistors of one channel type only.

The control transistor and the selection transistor can be of the same channel type as the driver transistor, the switching transistor and the output transistor.

In at least one embodiment, a display device comprises

- a plurality of image elements arranged in rows and columns in a matrix-like manner,
- a plurality of column lines, each connected to a respective signal input of the image elements of one of the columns,
- a plurality of further column lines, each connected to a respective control signal input of the image elements of one of the columns,
- a plurality of row lines, each connected to a respective selection input of the image elements of one of the rows, and
- a control device connected on the output side to the plurality of column lines, the plurality of further column lines, and the plurality of row lines.

The display device may comprise a matrix or array of pixels or pixel cells, each having at least one image element.

According to at least one embodiment, the display device is realized as a single-color display device (such as a black-and-white display device). Then, a pixel or pixel cell comprises exactly one image element.

According to at least one alternative embodiment, the display device is realized as a colored display device. Then, a pixel or pixel cell can comprise three image elements, such as a "red", a "green" and a "blue" image element.

In at least one embodiment, an electronic device includes the display device described herein. The electronic device may be a communication terminal, a television, a laser printer, or a camera.

In at least one embodiment, the image element may find application in a light source. For example, the image element is intended for general lighting, such as interior or exterior lighting. The image element may be implemented as a light source for a headlight, such as a motor vehicle headlight.

In at least one embodiment, a method for operating an image element comprises:

- applying a supply voltage between first and second supply terminals, the supply voltage dropping across a series circuit comprising a light emitting semiconductor component and a driver transistor, supplying a current setting voltage to a storage capacitor, wherein a first electrode of the storage capacitor is coupled to a control terminal of the driver transistor, supplying a trigger setting voltage to a control capacitor, wherein a first electrode of the control capacitor is coupled to a control terminal of an output transistor, providing an output signal by the output transistor, and turning on and/or turning off a current flow through the light emitting semiconductor component by a switching transistor controlled by the output signal.

Advantageously, in the method, both a current setting voltage and a trigger setting voltage are supplied to two storing elements, namely the storage capacitor and the control capacitor. Here, the current setting voltage is used to set the driver transistor and thus to set a value of the current flow through the light emitting semiconductor component.

According to at least one embodiment of the method, a capacitor voltage applied to the control capacitor changes after the trigger setting voltage is applied, such that the value of the output signal is changed and therefore the current flow through the light emitting semiconductor component is either turned on or turned off.

Advantageously, a capacitor voltage that can be tapped at the control capacitor depends on the supplied trigger setting voltage. In this case, the capacitor voltage is changed after the trigger setting voltage is applied in such a way that the switching transistor changes from a conductive to a non-conductive state or vice versa, so that the current flow through the light emitting semiconductor component is switched on or off. Advantageously, the trigger setting voltage can be used to vary the time at which the switching transistor changes from a non-conducting state to a conducting state or vice versa.

According to at least one embodiment of the method, after the trigger setting voltage is applied, the capacitor voltage changes due to self-discharge of the control capacitor.

The method described here is particularly suitable for the operation of an image element described here. The features described in connection with the image element can therefore also be used for the method and vice versa.

The image element can be realized as a pixel cell or sub-pixel. The display device can be realized as an active matrix display device. The light emitting semiconductor component can be implemented as a light emitting diode (LED), in particular as a μLED.

According to at least one embodiment, the image element realizes a circuit for generating pulse width modulation, abbreviated PWM, within the image element of a μLED active matrix display device.

According to at least one embodiment of an active matrix display device based on μLEDs, each pixel (or pixel cell) comprises three sub-pixels. The three sub-pixels each comprise a LED or μLED. Each of the LEDs or μLEDs is a red chip, a green chip, and a blue chip. Each of these sub-pixels has a circuit with active components in the form of thin film transistors (TFTs) for regulating the current flow through the light emitting semiconductor component, also called LED current. The transistor for current control is called a driver transistor. To regulate this current flow, a storage capacitor is programmed in each frame, which is connected to the gate terminal of the driver transistor. To adjust the brightness of individual sub-pixels, the current flow can be controlled analogously via a programming voltage. Since LEDs have a dependency between color location and current, changes in the white point can occur in pure analog operation. To avoid this change, the brightness of the sub-pixels is advantageously adjusted using pulse width modulation (abbreviated to PWM). This is referred to as digital operation. A sub-pixel is operated exclusively for a certain time with a nominal current and remains off for the remainder of the time. The viewer perceives the average brightness over time as the static brightness of the sub-pixel. The image element described here realizes a circuit to generate the PWM within the sub-pixel. In the image element, the PWM is generated with a circuit consisting solely of five transistors and two capacitors. The pixel cell can therefore be produced very compactly, which means that a high resolution can be achieved.

In addition to the storage capacitor, which is used for programming the driver transistor, there is another capacitor in the circuit, called the control capacitor, which can be used to control the PWM. The control capacitor is charged to a specific value during programming. During a frame time, the control capacitor discharges continuously. If the voltage at the control capacitor falls below a certain value, the LED in the pixel cell is switched off. The programmed voltage can be used to control the time during which the LED is lit.

Advantageously, the effective brightness of the LED within a frame can be controlled by the time it is lit and not by the current. Thus, a color shift can be counteracted. The circuit of the image element can be combined with common display drivers. Either one scan and two data lines or two scan and one data line can be used for programming the two capacitors.

According to at least one embodiment of the image element, the light emitting semiconductor component is realized as a light emitting diode or micro light emitting diode. These may be formed from a III/V compound semiconductor material. A III/V compound semiconductor material has an element from the third main group, such as B, Al, Ga, In, and an element from the fifth main group, such as N, P, As. In particular, the term "III/V compound semiconductor material" comprises the group of binary, ternary or quaternary compounds containing at least one element from the third main group and at least one element from the fifth main group, for example nitride and phosphide compound semiconductors. Such a binary, ternary or quaternary compound may further include, for example, one or more dopants as well as additional constituents. Also, the semiconductor body may be formed of a II/VI compound semiconductor material.

A μLED can be made of indium gallium nitride InGaN, for example.

According to at least one alternative embodiment of the image element, the light emitting semiconductor component is realized as a laser diode, for example as a vertical-cavity surface-emitting laser, abbreviated VCSEL.

BRIEF DESCRIPTION OF THE DRAWINGS

Further embodiments and further embodiments of the image element or of the method for operating an image element result from the exemplary embodiments explained below in connection with FIGS. 1 to 6. Identical, similar or identically acting circuit parts and components are provided with the same reference signs in the figures. They show.

DETAILED DESCRIPTION

Figure 1:
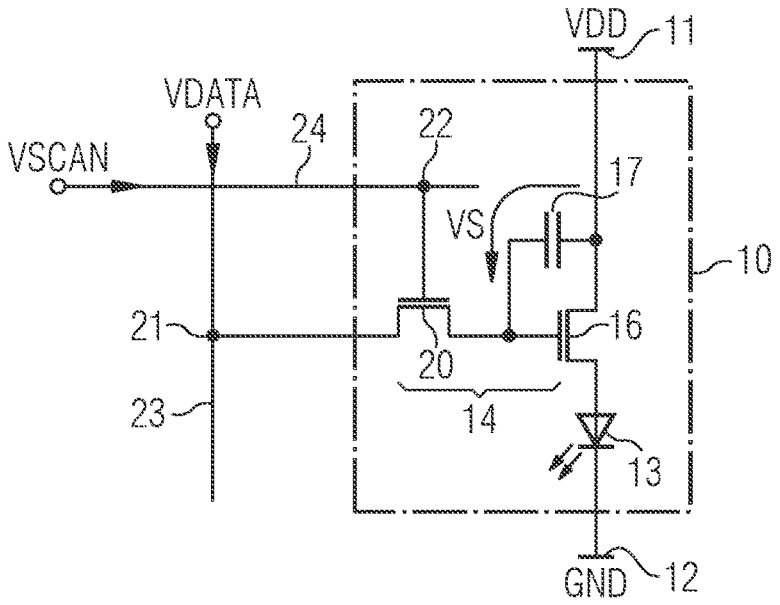
FIG. 1 an example of an image element.

FIG. 1 shows an example of an image element 10 with a first and a second supply terminal 11, 12, a light emitting semiconductor component 13 (abbreviated as semiconductor component in the following) and a driver circuit 14. The first supply terminal 11 may be realized as a voltage supply terminal. The second supply terminal 12 may be designed as a reference potential terminal. The semiconductor component 13 is realized as a light emitting diode, abbreviated as LED. The LED may be produced as a μLED or as a high-power LED. The driver circuit 14 comprises a driver transistor 16. The driver transistor 16 is connected in series with the semiconductor component 13. A series circuit comprising the driver transistor 16 and the semiconductor component 13 couples the first supply terminal 11 to the second supply terminal 12, with the driver transistor 16 connected to the first supply terminal 11 and the semiconductor component 13 connected to the second supply terminal 12.

In addition, the driver circuit 14 comprises a storage capacitor 17. A first electrode of the storage capacitor 17 is connected to a control terminal of the driver transistor 16. A second electrode of the control capacitor 17 is connected to the first supply terminal 11. A first terminal of the driver transistor 16 is connected to the first supply terminal 11. A second terminal of the driver transistor 16 is coupled to the second supply terminal 12 via the semiconductor component 13.

In addition, the image element 10 comprises a selection transistor 20. Further, the image element 10 comprises a signal input 21. The signal input 21 is coupled to the first electrode of the storage capacitor 17 via the selection transistor 20. A control terminal of the selection transistor 20 is connected to a selection input 22 of the image element 10. The signal input 21 is connected to a first column line 23. Accordingly, the control input 22 is connected to a first row line 24.

A supply voltage VDD is applied to the first supply terminal 11. The supply voltage VDD can be positive. A reference potential GND can be tapped at the reference potential terminal 12. A current IL flows through the driver transistor 16 and the semiconductor component 13. A current setting voltage VDATA is applied to the first column line 23 and thus to the signal input 21. A selection signal VSCAN is applied to the first row line 24 and thus to the selection input 22. When the selection signal VSCAN makes the selection transistor 20 conductive, the current setting voltage VDATA is supplied from the first column line 23 via the signal input 21 and the selection transistor 20 to the first electrode of the storage capacitor 17 and the control terminal of the driver transistor 16. Subsequently, the selection transistor 20 is switched to non-conducting by the selection signal VSCAN. Thus, a storage voltage VS is applied between the first electrode and the second electrode of the storage capacitor, which can be calculated according to the following equation:

$$VS = VDD - VDATA,$$

where VDD is a value of the supply voltage and VDATA is a value of the current setting voltage. Thus, the storage voltage VS is applied, for example, between a source terminal and a gate terminal of the driver transistor 16. More generally, it may be true, for example:

$$|VS| = |VDD - VDATA|$$

Consequently, the storage voltage VS determines a value of the current flow IL. According to this example, a brightness of the image element can be preset by setting the value of the current flow IL.

The circuit of the image element 10, also called pixel cell or cell, in an active matrix μLED display device are based on a so-called 2T1C cell illustrated in FIG. 1. A mode of operation is as follows: Each image element 10 has driver transistor 16, selection transistor 20 and storage capacitor 17. The transistors 16, 20 may be realized as thin film transistors (abbreviated as TFT). A line of a display device (shown in FIG. 6) is selected via the selection signal VSCAN. The storage voltage VS on the storage capacitor 17 can be programmed via the current setting voltage VDATA. The storage capacitor 17 is programmed once per frame and holds the storage voltage VS until the next programming. The control terminal of driver transistor 16 is connected to storage capacitor 17, a source terminal of driver transistor 16 is connected to supply voltage VDD, and a drain terminal of driver transistor 16 is connected to reference potential GND (via semiconductor component 13). A constant current flow IL is generated via the constant voltage at the control terminal of the driver transistor 16, which flows through the semiconductor component 13 realized as a μLED. The brightness of the semiconductor component 13 is controlled by the current flow IL. The regulation of the current flow IL and thus of the brightness is analogous.

The transistors 16, 20 of the image element 10 are realized as PMOS transistors. Since there is a dependency between color location and current in μLEDs, changes in the white point can occur in pure analog operation.

Figure 2A:
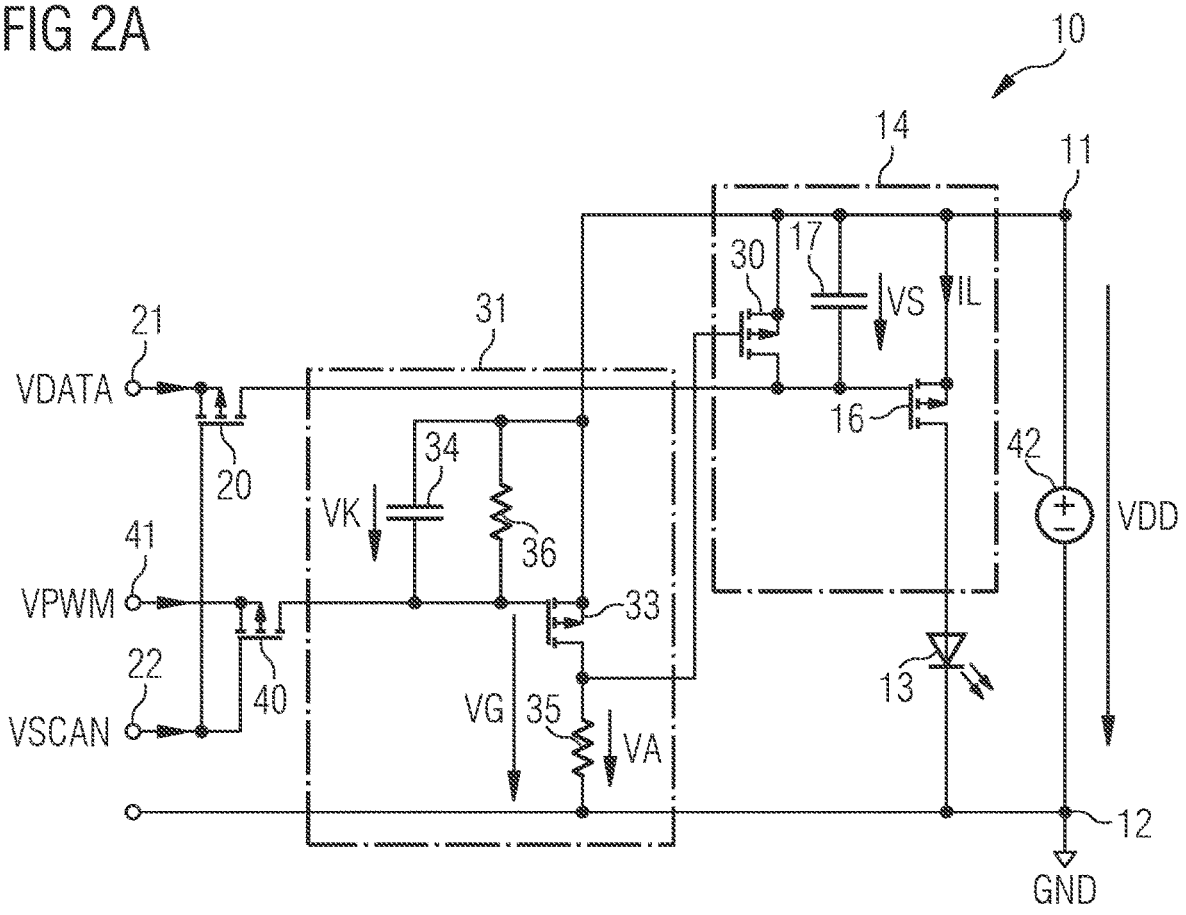
FIGS. 2A to 2G an exemplary embodiment of an image element and signal waveforms.

FIG. 2A shows an exemplary embodiment of an image element 10 which is a further development of the embodiment shown in FIG. 1. The driver circuit 14 comprises the driver transistor 16 shown in FIG. 1 and the storage capacitor 17. In addition, the driver circuit 14 comprises a switching transistor 30 that couples the control terminal of the driver transistor 16 to the first supply terminal 11. Thus, the switching transistor 30 couples the first electrode of the storage capacitor 17 to the second electrode of the storage capacitor 17.

In addition, the image element comprises a trigger circuit 31 connected on the output side to a control terminal of the switching transistor 30. The trigger circuit 31 is designed to be monostable, for example. The trigger circuit 31 may be realized in a post-triggerable manner. The trigger circuit 31 may be implemented as a monostable trigger circuit stage, monoflop or univibrator. The trigger circuit 31 comprises an output transistor 33 and a control capacitor 34. Further, the flip circuit 31 comprises an output resistor 35 coupling a first terminal of the output transistor 33 to the second supply terminal 12. A control terminal 35 of the output transistor 33 is coupled to a second terminal of the output transistor 33 via the control capacitor 34. The second terminal of the output transistor 33 is connected to the first supply terminal 11.

Further, the trigger circuit 31 comprises a control resistor 36 that couples the first terminal of the control capacitor 34 to the second terminal of the control capacitor 34. Thus, the control resistor 36 couples the control terminal of the output transistor 33 to the second terminal of the output transistor 33.

In addition, the image element 10 comprises a control transistor 40. At a first terminal, the control transistor 40 is connected to a control signal input 41. At a second terminal, the control transistor 40 is connected to the control input of the output transistor 33. A control terminal of the control transistor 40 is connected to the selection input 22. Thus, the control terminal of the control transistor 40 is coupled to the control terminal of the selection transistor 20. A voltage source 42 is arranged between the first and second supply terminals 11, 12 (the voltage source 42 may, for example, be a part of the display device 50 shown in FIG. 6).

The voltage source 42 outputs the supply voltage VDD. An output signal VA can be tapped at a node between the output transistor 33 and the output resistor 35. The output signal VA is supplied to the control terminal of the switching transistor 30. The selection signal VSCAN is supplied to both the control terminal of the control transistor 40 and the control terminal of the selection transistor 20. When the control transistor 40 is rendered conductive, a trigger setting voltage VPWM is applied to the first electrode of the control capacitor 34 and the control terminal of the output transistor 33 via the control signal input 41 of the image element 10 and the control transistor 40. A capacitor voltage VK drops across the control capacitor 34, which can be calculated, for example, according to the following equation:

$$VK=VDD-VPWM,$$

where VDD is a value of the supply voltage and VPWM is a value of the trigger setting voltage. More generally, it may be true, for example:

$$|VK|=|VDD-VPWM|$$

During turn-on of the control transistor 40 and immediately thereafter, the capacitor voltage VK satisfies the above equation. Due to a current flow through the control resistor 36, the capacitor voltage VK decreases and thus a control voltage VG applied to the control terminal of the output transistor 33 increases:

$$VG=VDD-VK$$

The control voltage VG can reach the value of the supply voltage VDD at maximum. The driver transistor 16, the switching transistor 30 and the output transistor 33 are implemented as P-channel field effect transistors. At a low value of the trigger setting voltage VPWM and thus a low initial value of the control voltage VG, the output transistor 33 is conductive. When the value of the control voltage VG is low, the output signal VA is high, so that the switching transistor 30 is non-conducting. The semiconductor component 13 is illuminated. The current flow IL through the semiconductor component 13 is adjusted by the storage voltage VS.

When the control voltage VG rises due to the current flowing through the control resistor 36, the output transistor 33 changes from a conductive state to a non-conductive state so that the output signal VA returns to the value of the second supply terminal 12 and thus to the reference potential GND. As a result, the switching transistor 30 becomes conductive and short-circuits the storage capacitor 30. As a result, the driver transistor 16 is switched non-conducting.

The processes are repeated periodically with a specified time duration T. Thus, the value of the trigger setting voltage VPWM determines the time within the time duration T at which the driver transistor 16 is switched from the conductive state to the non-conductive state. Consequently, a brightness of the semiconductor component 13 and thus a brightness of the image element 10 depends on a value of the current setting voltage VDATA and on a value of the trigger setting voltage VPWM.

To keep a color location constant at different brightness levels, the brightness of the image element 10, referred to as a sub-pixel, can be adjusted using pulse width modulation (abbreviated PWM). The image element 10 is operated digitally. The image element 10 is operated exclusively for a certain time at the nominal current and remains off the remainder of the time. The average brightness over time is perceived by the viewer as the static brightness of the image element 10. Advantageously, the number of transistors and capacitors required is kept low.

The image element 10 is implemented in such a way that a circuit in the image element 10 generates the pulse width modulation itself. This circuit consists exclusively of five transistors and two capacitors. The image element 10 can therefore be manufactured compactly, effectively achieving a high resolution.

The image element 10 realizes the following concept: the transistors 16, 20 form the 2T1C cell. The 2T1C cell is extended by the control capacitor 34 and three transistors 30, 33, 40. The resistors 35, 36 are additional components to extend the 2T1C cell.

The trigger setting voltage VPWM is programmed on the control capacitor 34 via a further column line (also called scan line). During the frame time, the control capacitor 34 discharges via the control resistor 36. If the voltage at the control capacitor 34 falls below a certain value, the μLED 13 in the image element 10 is switched off. The time during which the μLED 13 lights up can be controlled via the trigger setting voltage VPWM.

The control capacitor 34 and the control resistor 36 form a low-pass or resistive-capacitive (abbreviated as RC) element. A threshold voltage VTH of the transistors 13, 20, 30, 33, 40 of the image element 10 is negative, for example, it is about −2V. The transistors 13, 20, 30, 33, 40 of the image element 10 are self-blocking. The transistors 13, 20, 30, 33, 40 of the image element 10 are realized as metal-oxide-semiconductor field-effect transistors, abbreviated MOSFET.

A mode of operation of the image element 10 is as follows: A line is selected with the selection signal VSCAN. The current setting voltage VDATA is used to program the storage capacitor 17 via the signal input 21, which causes a constant current flow IL through the driver transistor 16. The trigger setting voltage VPWM is used to program the control capacitor 34 via the control signal input 41, with the control terminal of the output transistor 33 connected to the control capacitor 34. Thus, immediately after programming, the control voltage VG is equal to the trigger setting voltage VPWM; VG=VPWM. The control capacitor 34 is discharged within one frame through the control resistor 36. The output transistor 33 is conducting as long as VG<VDD+VTH holds, so the switching transistor 30 is non-conducting (VTH is a threshold voltage of the output transistor 33).

When the output transistor 33 becomes non-conductive, the control terminal of the switching transistor 30 is pulled to the reference potential GND via the output resistor 35.

When the output transistor 33 becomes conductive, the control terminal of the switching transistor 30 is pulled to the supply voltage VDD via the output transistor 33. When this happens, the driver transistor 16 becomes non-conductive and the semiconductor component 13 (such as a μLED) turns off.

The product of the resistance value R1 of the control resistor 36 and the capacitance value C1 of the control capacitor 34 gives a time constant Tau (Tau=R1·C1 or Tau~R1~C1). For example, the components could be designed as follows:

The time constant Tau corresponds approximately to a frame time: This results in a full PWM control effect due to the discharge of the control capacitor 34 via the control resistor 36.

Alternatively: Time constant Tau>>frame time T: This results in a longer discharge, which leads to a small control range.

Alternatively, time constant Tau<<frame time T: This results in a fast discharge, such that the semiconductor component 13 switches off even if VPWM=0 in the frame.

Figure 2B:
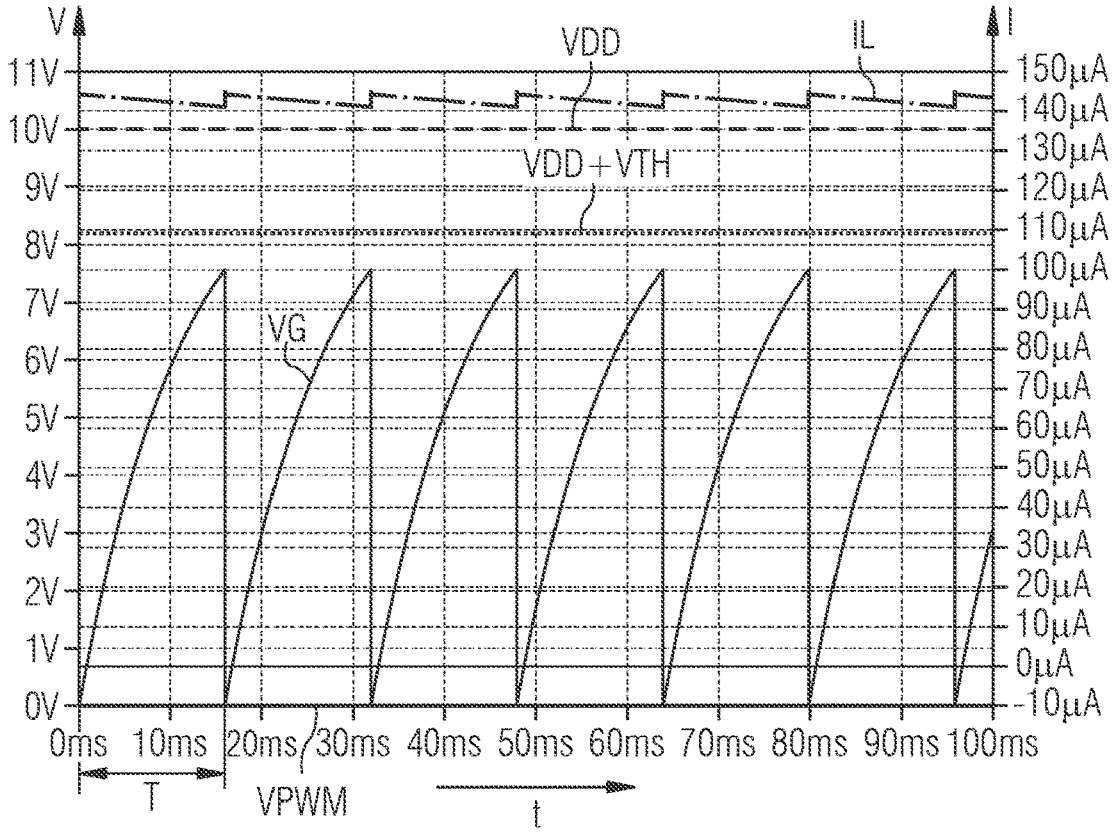

FIGS. 2B to 2F show exemplary embodiments of signal waveforms of the image element 10 according to FIG. 2A. FIGS. 2B to 2F show the control voltage VG of the output transistor 33, the trigger setting voltage VPWM, the supply voltage VDD, a sum voltage VDD+VTH, and the current flow IL as a function of a time t. The values of the current flow IL were simulated for different trigger setting voltages VPWM (at a supply voltage VDD=10V). The processes can be repeated with the time duration T. The time duration T corresponds to a frame time. In FIG. 2B, the trigger setting voltage VPWM is at 0 Volts. Thus, the control voltage VG at the control terminal of the output transistor 33 starts at 0 Volts and increases. However, since the control voltage VG does not reach the value of a sum voltage VDD+VTH, the output transistor 33 is permanently conducting. The current flow IL is almost constant at a high value.

Figure 2C:
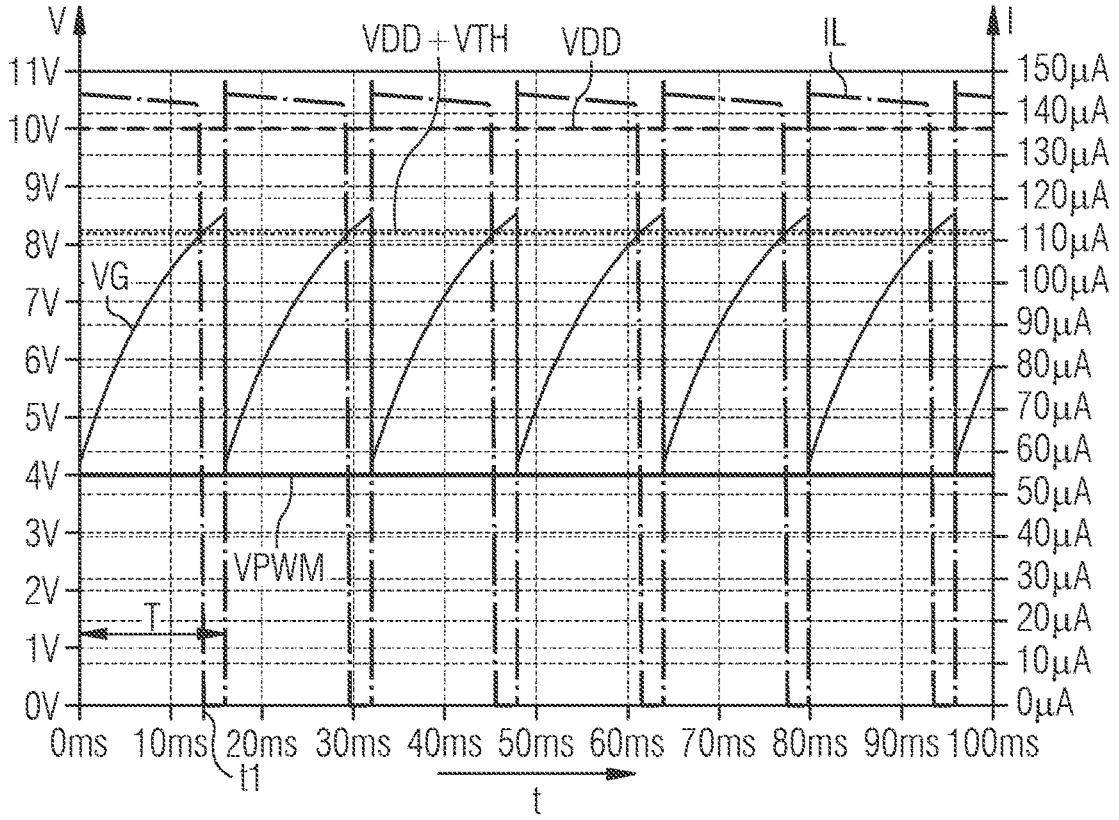

According to FIG. 2C, the trigger setting voltage VPWM has the value VPWM=0.4·VDD. The control voltage VG of the output transistor 33 thus increases from this value to a value above the sum voltage, so that at a time t1 the output transistor 33 is switched non-conducting, the switching transistor 30 is switched conducting and the driver transistor 13 is switched non-conducting. From this time t1, the current flow IL takes the value 0; the current flow IL does not take a high value again until the beginning of the next time period T.

Figure 2D:
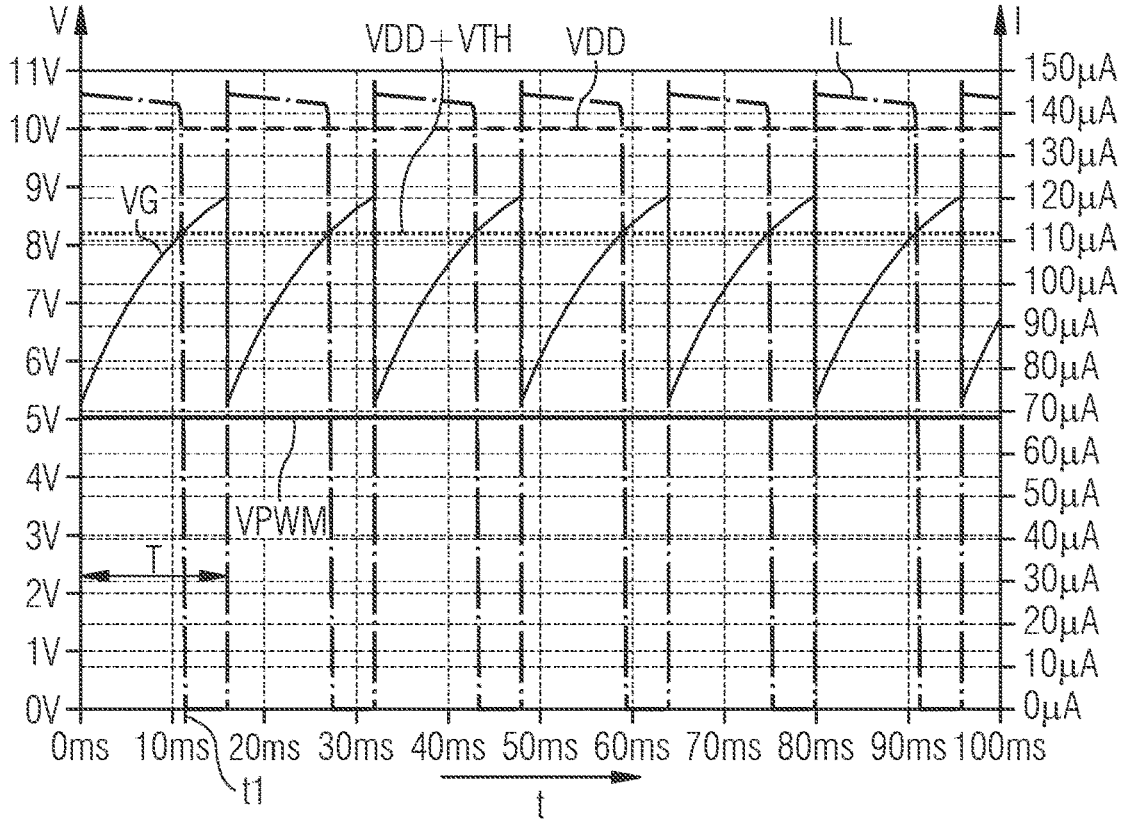

According to FIG. 2D, the trigger setting voltage VPWM has the value VPWM=0.5·VDD. The time t1 is reached faster.

Figure 2E:
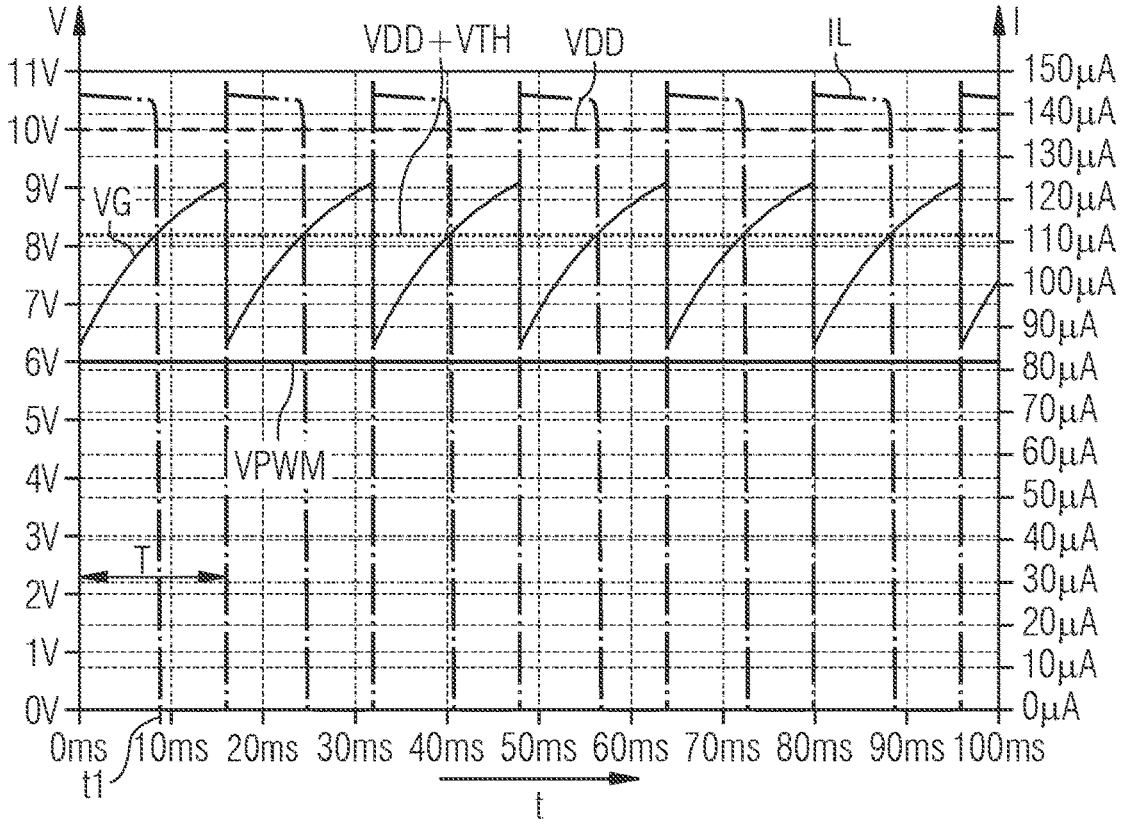

According to FIG. 2E, the trigger setting voltage VPWM has the value VPWM=0.6·VDD. The time t1 of the switchover is reached even earlier.

Figure 2F:
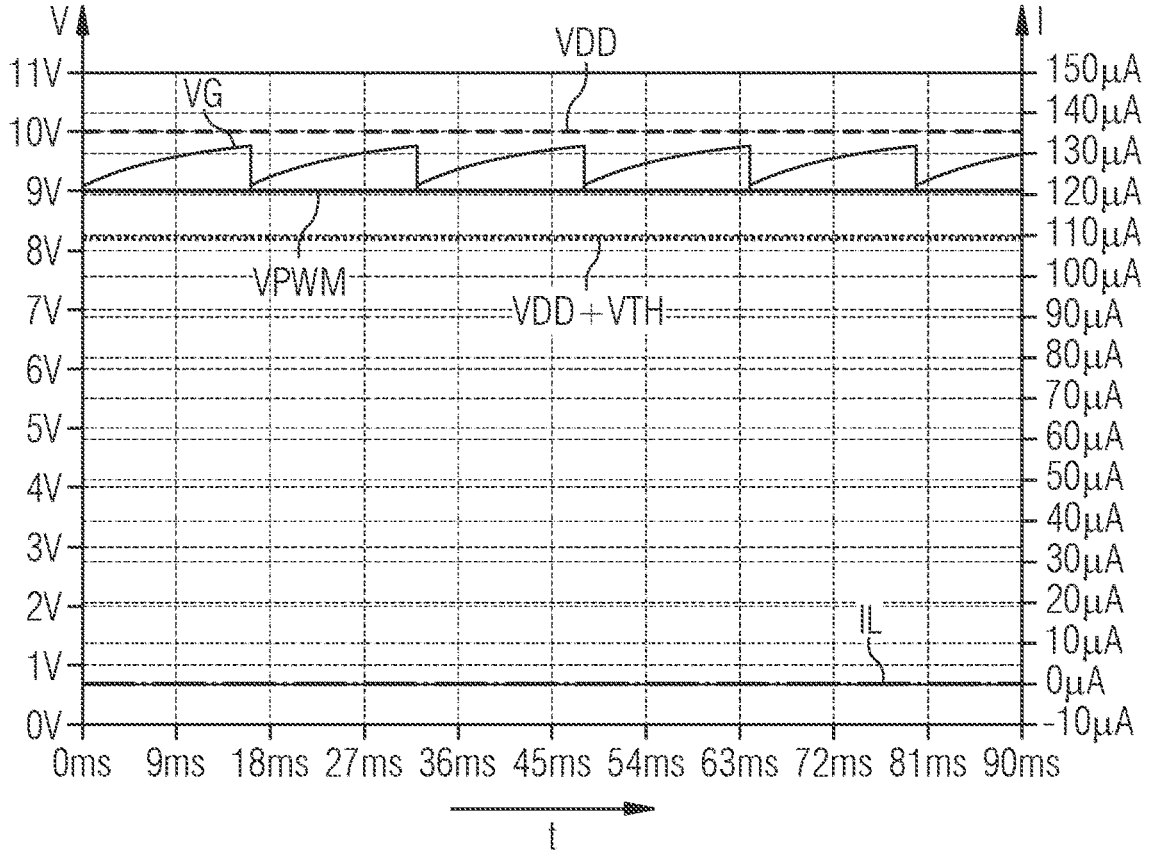

According to FIG. 2F, the trigger setting voltage VPWM has the value VPWM=0.9·VDD. The trigger setting voltage VPM is above the value of the sum voltage. Thus, the output transistor 33 is continuously non-conducting and the switching transistor 30 is continuously conducting. Since the driver transistor 16 is thus continuously non-conducting, the current flow IL is at the value 0.

Figure 2G:
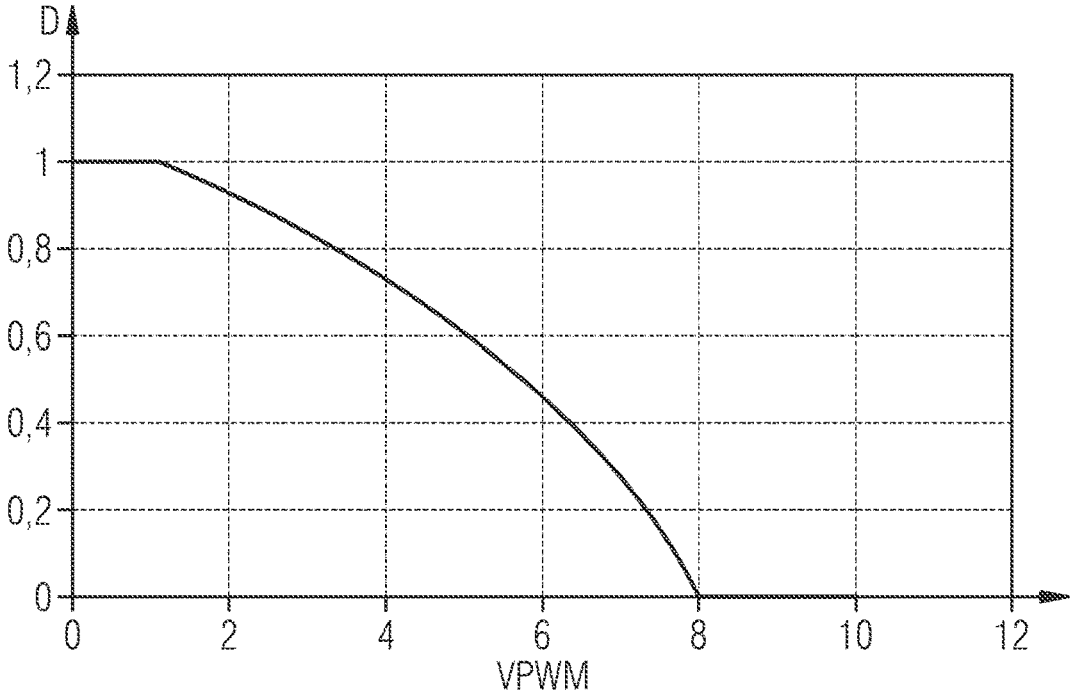

FIG. 2G shows an exemplary dependence between the trigger setting voltage VPWM and a duty cycle D of the image element 10 according to FIG. 2A. The duty cycle D (also called PWM duty cycle) is indirectly proportional to the trigger setting voltage. By varying the trigger setting voltage VPWM, duty cycles D between 0 and 1 or between 0% and 100% can be achieved. The resolution of the pulse width modulation (abbreviated PWM) depends on the design of the RC element, formed by the control capacitor 34 and the control resistor 36, and on the accuracy with which the trigger setting voltage VPWM can be programmed. FIG. 2G shows the relationship between VPWM and the resulting duty cycle for a frame time T~1.5·Tau and the supply voltage VDD=10V. The trigger setting voltage VPWM shows an effective control action in the range from 1V to 8V. The relationship between the trigger setting voltage VPWM and the duty cycle D is not linear.

Figure 3A:
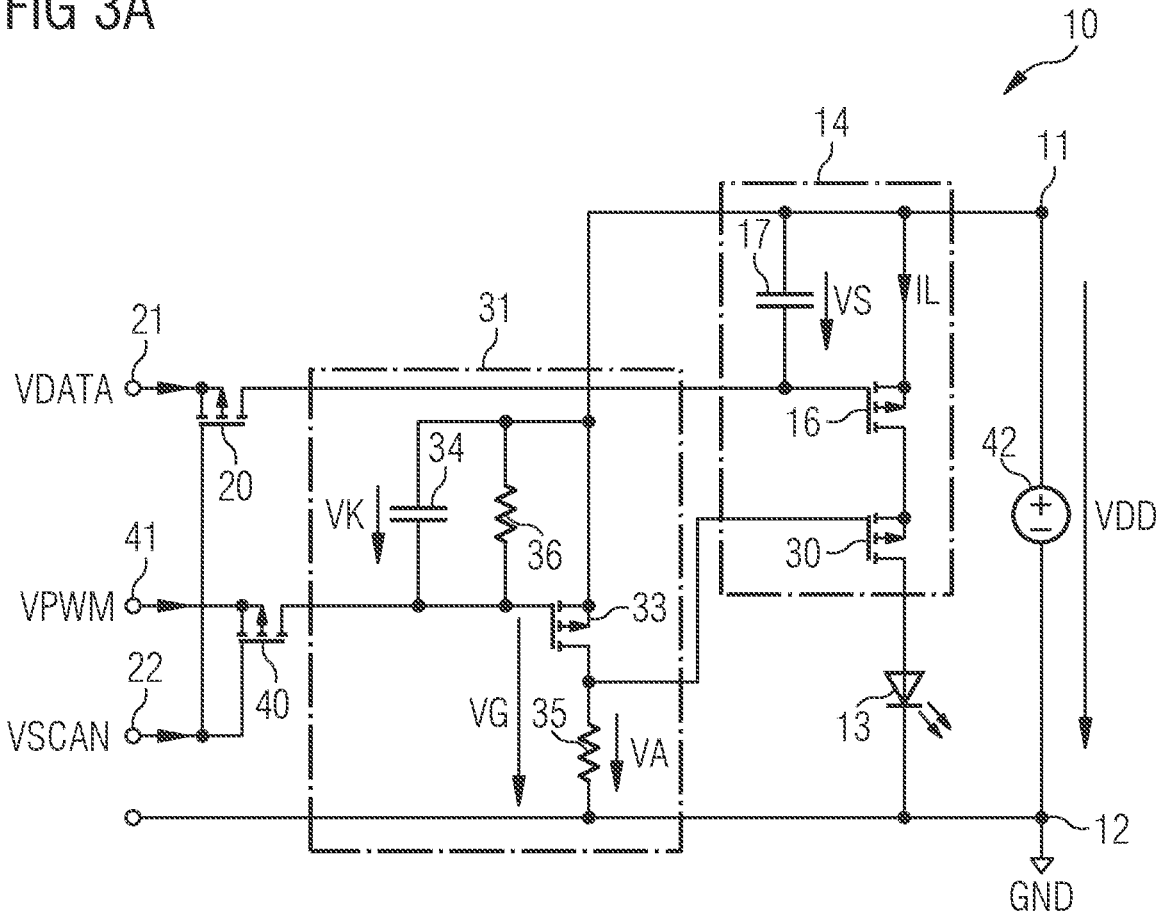
FIGS. 3A to 3G a further exemplary embodiment of an image element and signal waveforms.

FIG. 3*a* shows a further exemplary embodiment of an image element 10, which is a further development of the embodiments shown in FIGS. 1A and 2A. According to FIG. 3A, the switching transistor 30 is arranged between the semiconductor component 13 and the driver transistor 16. A series circuit comprising the driver transistor 16, the switching transistor 30 and the semiconductor component 13 couples the first supply terminal 11 to the second supply terminal 12. Thus, the current flow IL flows through the driver transistor 16, the switching transistor 30 and the semiconductor component 13. At the beginning of a time period T, the switching transistor 30 is rendered non-conducting by the output signal VA. That is, at the beginning of the time period T, no current flows through the semiconductor component 13. At the time t1, a current flow through the control resistor 36 has reduced the capacitor voltage VK, so that the switching transistor 30 is made conductive by means of the output signal VA, and consequently the current flow IL flows through the above series circuit. The magnitude of the current flow IL is thereby predetermined by the storage voltage VS applied to the storage capacitor 17.

For example, the operation of the image element 10 is: A line is selected with the selection signal VSCAN. The storage capacitor 17 is programmed with the current setting voltage VDATA. No current IL flows through the semiconductor component 13 as long as the switching transistor 30 is non-conducting. The control capacitor 34 is programmed via the trigger setting voltage VPWM; the control terminal of the output transistor 33 is connected to the control capacitor 34; this initially results in VG=VPWM. The control capacitor 34 is discharged within one frame through the control resistor 36. The output transistor 33 is conductive as long as VG<VDD+VTH holds (VTH is the threshold voltage of the output transistor 33). As long as the output transistor 33 is conducting, the switching transistor 30 is non-conducting. If the output transistor 33 becomes non-conducting, the control terminal of the switching transistor 30 is pulled to the reference potential GND via the output resistor 35. When the output transistor 33 becomes conductive, a constant current IL can flow through the semiconductor component 13 realized as μLED.

The component design is similar to FIG. 2A, with one difference: if the time constant Tau<<frame time T, the result is a fast discharge, so that the semiconductor component 13 is turned on even when the trigger setting voltage VPWM=0 in the frame.

Figure 3B:
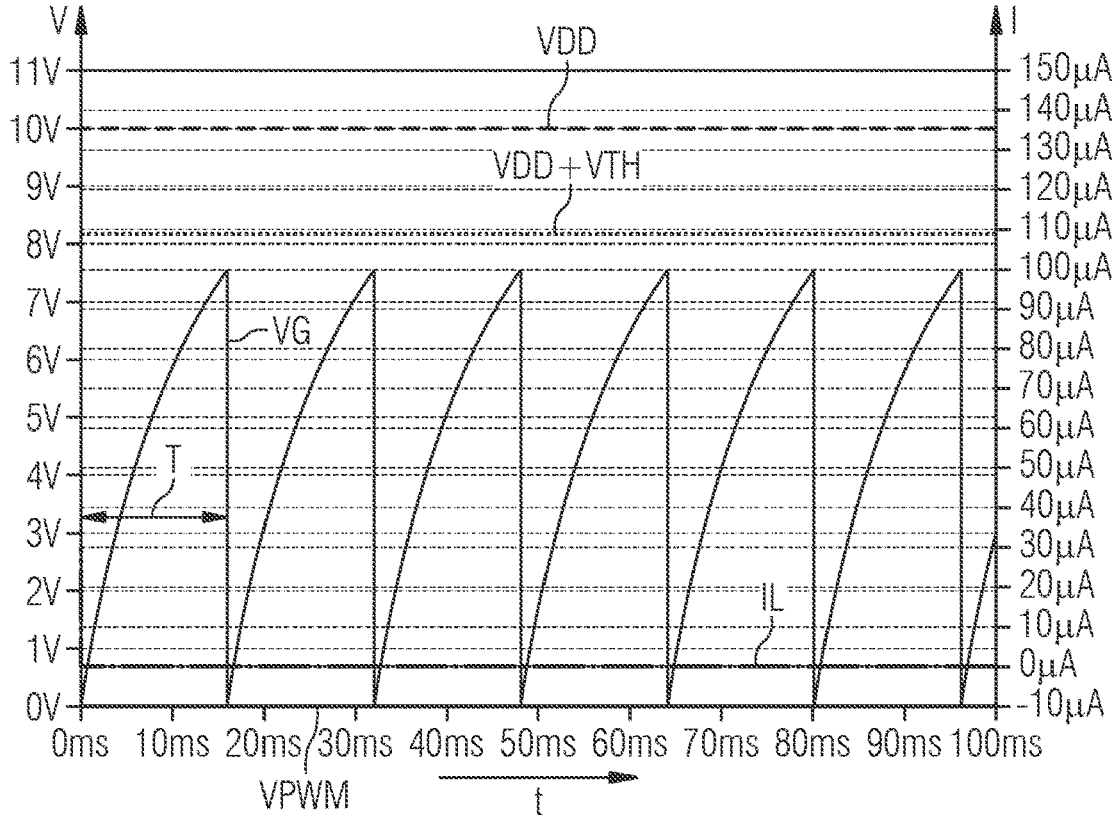

FIGS. 3B to 3F show the signals of the image element 10 for the following values of the trigger setting voltage VPWM (simulated results of the current flow IL at VDD=10V):

In FIG. 3B the following applies: VPWM=0V

Figure 3C:
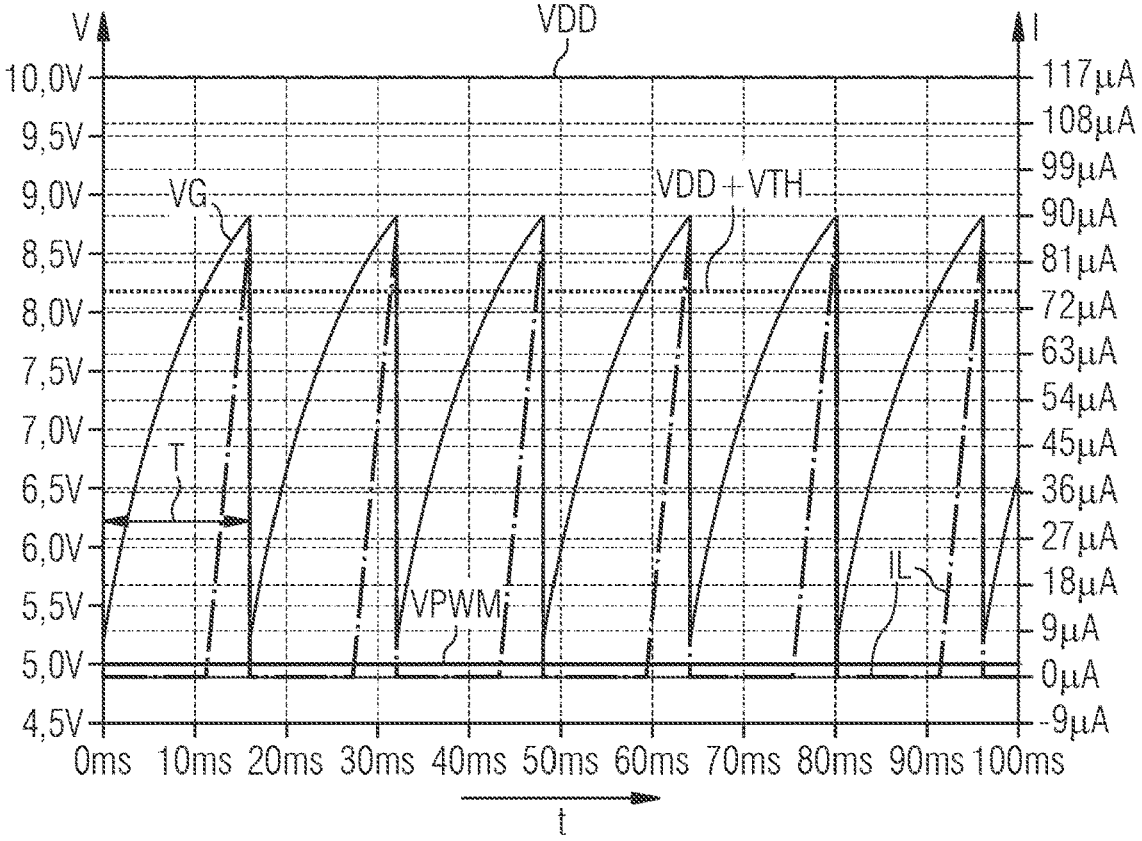

In FIG. 3C the following applies: VPWM=0.5·VDD

Figure 3D:
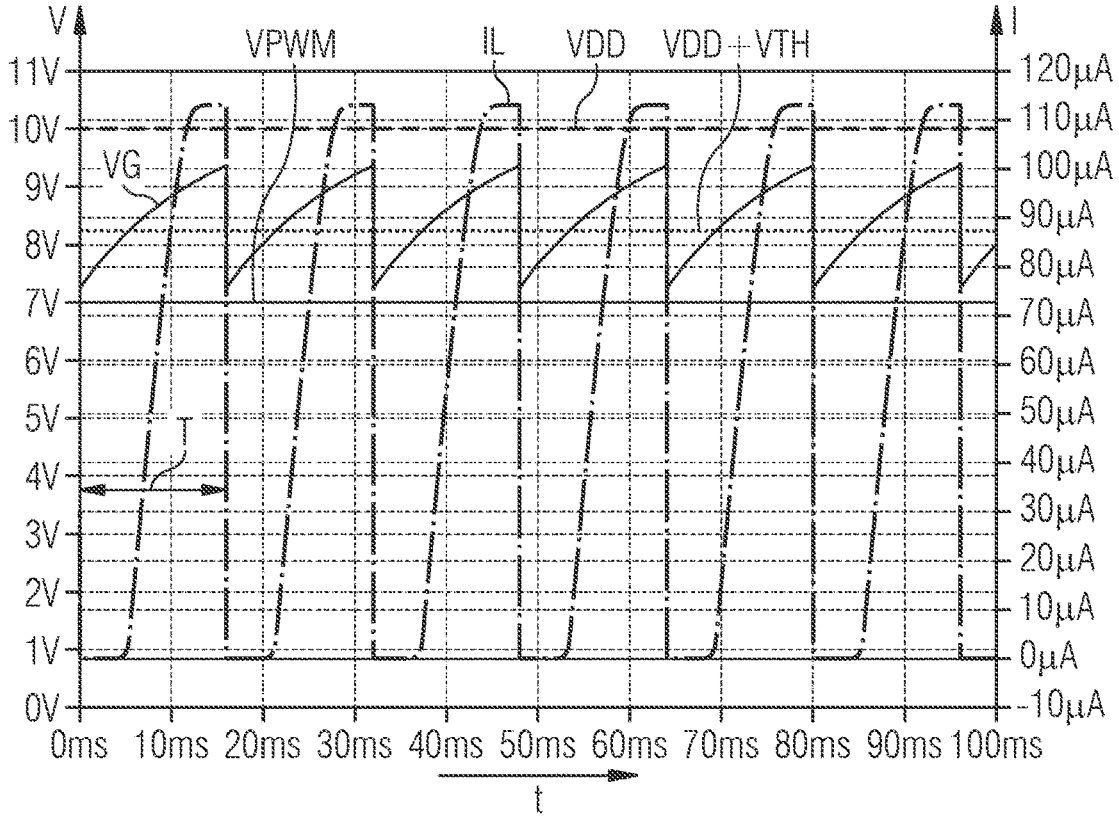

In FIG. 3D the following applies: VPWM=0.7·VDD

Figure 3E:
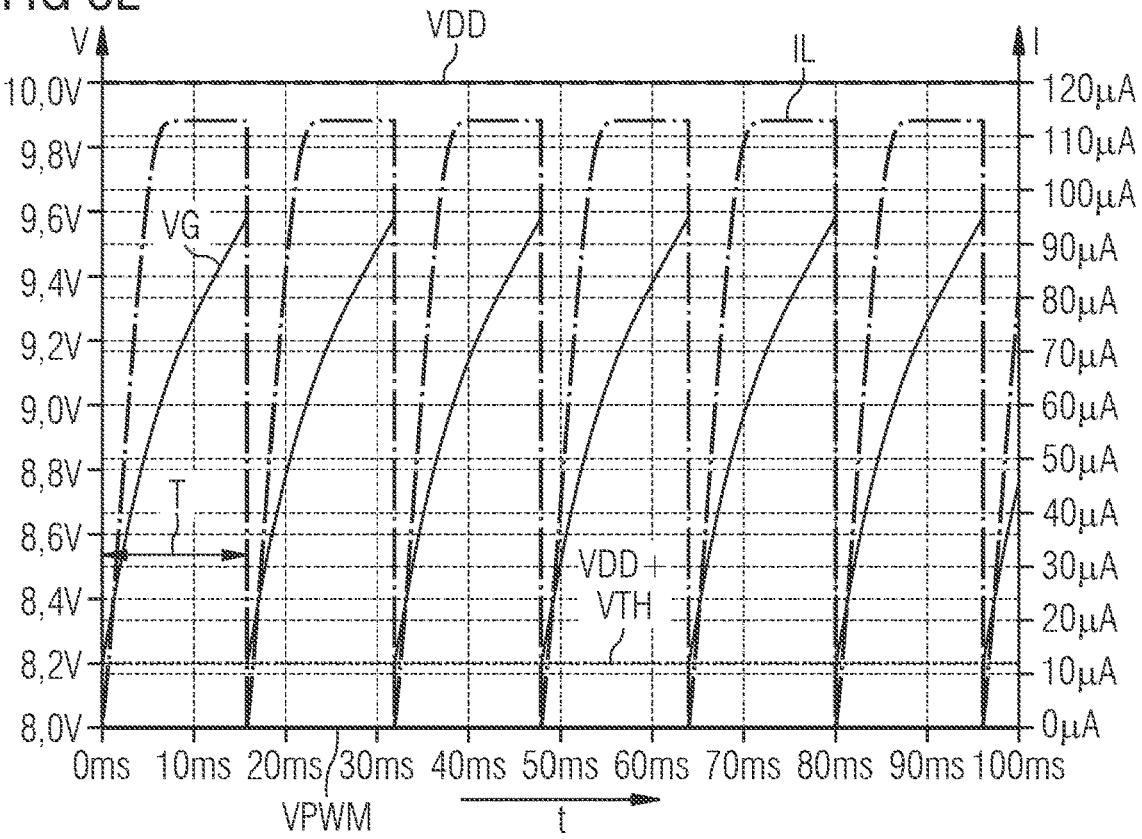

In FIG. 3E the following applies: VPWM=0.8·VDD

Figure 3F:
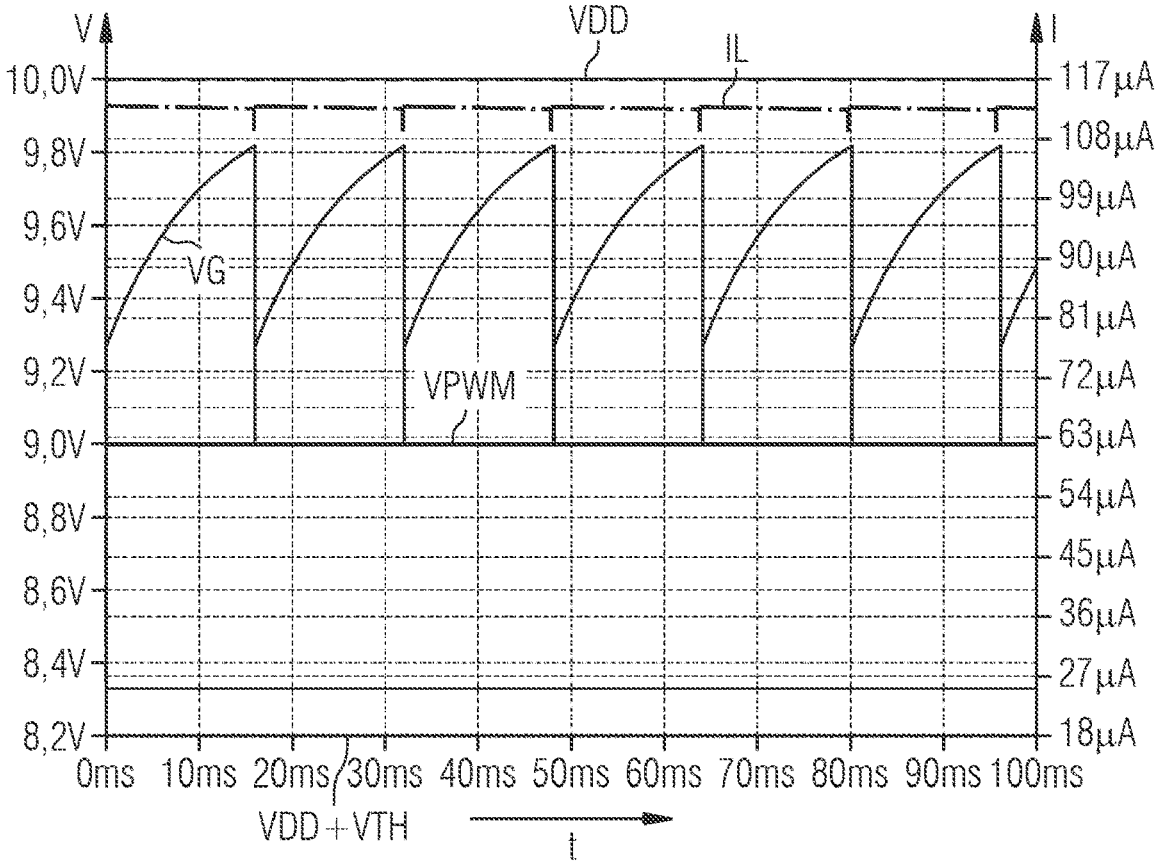

In FIG. 3F the following applies, VPWM=0.9·VDD

Figure 3G:
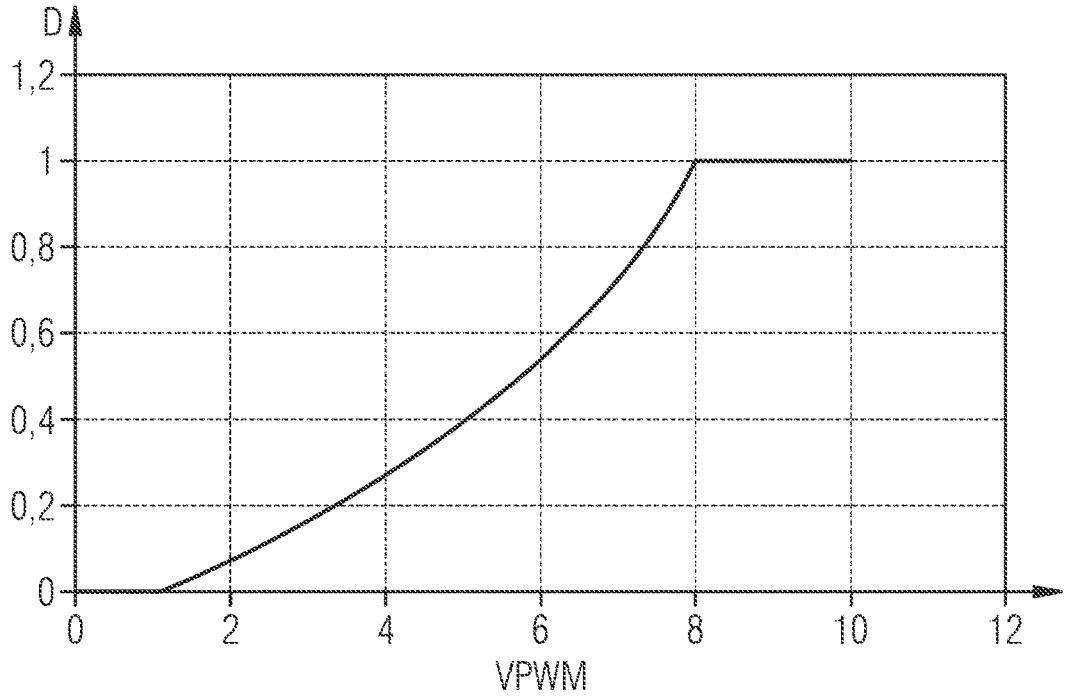

FIG. 3G shows an example of a dependence of the duty cycle D on the trigger setting voltage VPWM for a frame time T~1.5·Tau and a supply voltage VDD=10V. The PWM duty cycle D can be directly proportional to the trigger setting voltage VPWM. By varying the trigger setting voltage VPWM, duty cycles between 0% and 100% can be achieved. The trigger setting voltage VPWM has an effective control effect in the range from 1V to 8V. The relationship between the trigger setting voltage VPWM and the duty cycle D is not linear.

The exemplary embodiments of the image element 10 according to FIG. 2A and according to FIG. 3A differ somewhat in their characteristics. The image element 10 shown in FIG. 2A has the advantage of fast switching performance due to the triple amplification of the trigger setting signal VPWM. However, the storage capacitor 17 may possibly be discharged via a leakage current through the switching transistor 30, which may cause the current flow IL (also called analog current level of the μLED) to change during a frame.

The advantage of the image element 10 according to FIG. 3A is that there is no discharge of the storage capacitor 17 via an additional transistor and thus a constant current flow IL is achieved during a frame. However, the switching behavior may be slower, since only a double amplification of the trigger setting signal VPWM is obtained.

The exemplary embodiments of the image element 10 according to FIGS. 2A and 3A can both be implemented with standard active matrix drivers. There are two possible concepts here: The image element 10 comprises a selection input 22 with associated row line 24 (for switching through the current setting voltage VDATA and the trigger setting voltage VPWM) and two signal inputs 21, 42 with associated column lines (one each for the current setting voltage VDATA and the trigger setting voltage VPWM); this is shown in FIGS. 2A and 3A. Alternatively, the image element 10 comprises two selection inputs 22 with associated row lines 24 (one each for the current setting voltage VDATA and for the trigger setting voltage VPWM) and a control signal input 41 with an associated column line 23 (together for providing the current setting voltage VDATA and the trigger setting voltage VPWM).

Figure 5:
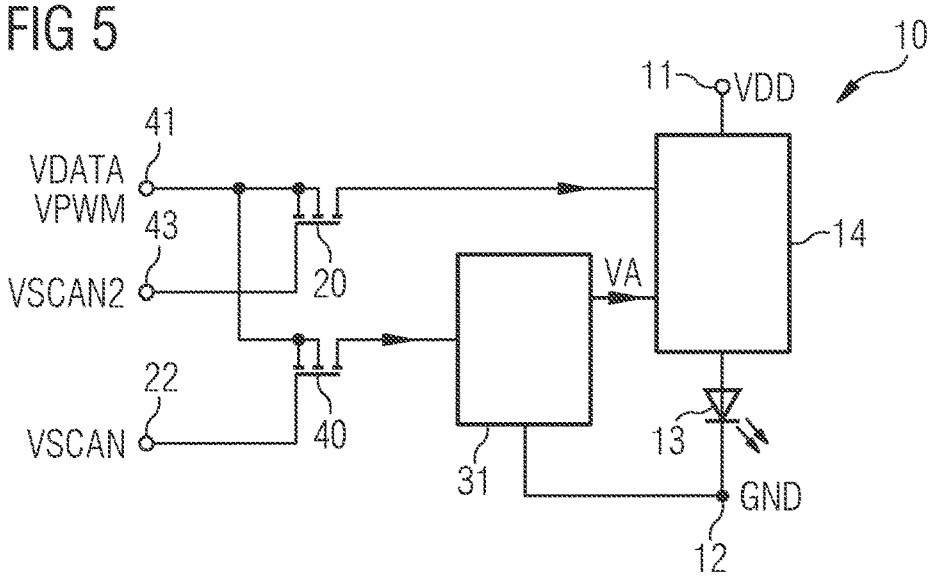
FIG. 5 an alternative exemplary embodiment of a detail of an image element.

The common control signal input 41 and the common column line 23 are used in a multiplexing method (see also FIG. 5).

In one example, the time constant Tau is chosen to correspond approximately to the target frame time T.

Figure 4A:
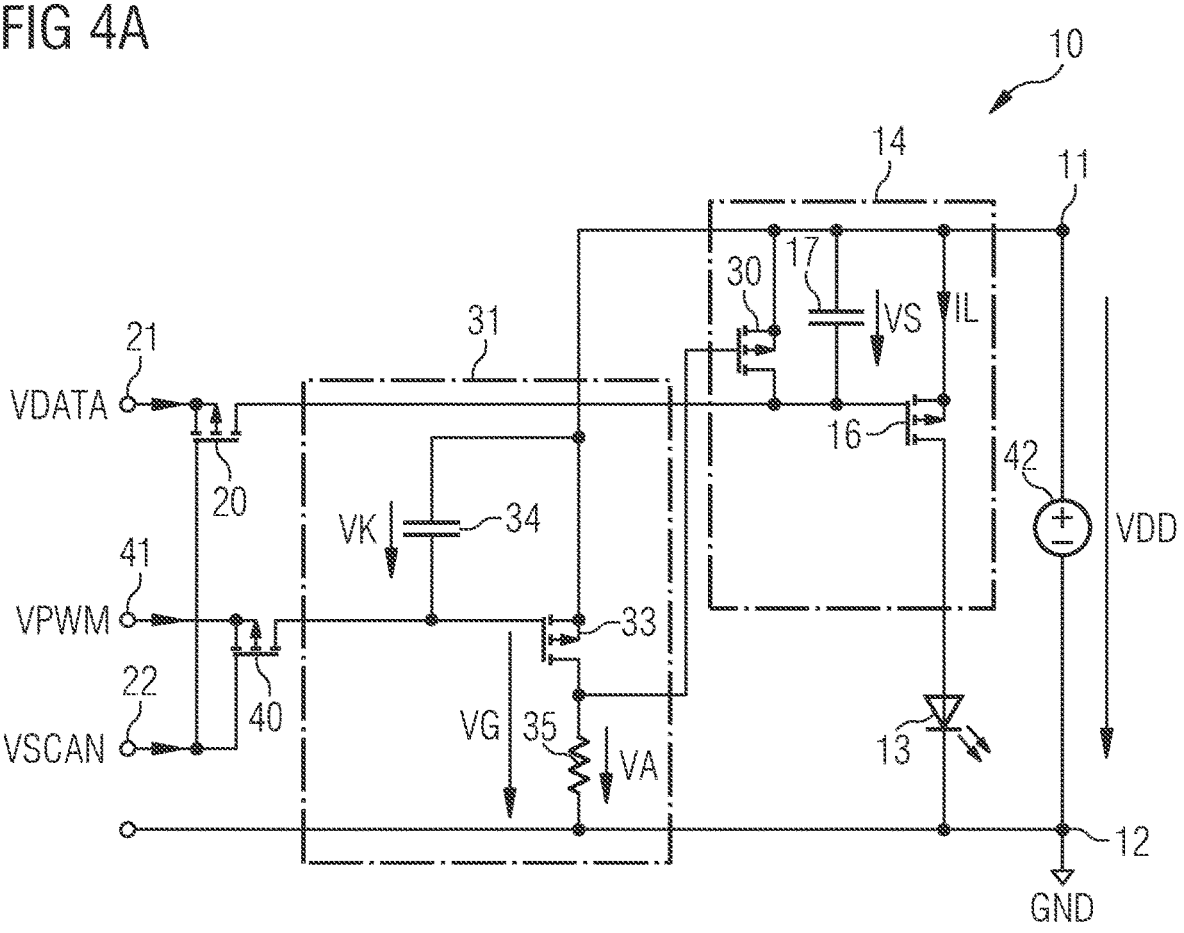
FIGS. 4A to 4C additional exemplary embodiments of an image element.

FIG. 4A shows an alternative exemplary embodiment of an image element 10 that is a further development of the embodiments shown in FIGS. 1, 2A and 3A. The image element 10 is free of the control resistor 36, that is, the image element 10 is free of any resistor coupling the first electrode of the control capacitor 34 to the second electrode of the control capacitor 34. The control capacitor 34 is discharged by a parasitic resistor within the control capacitor 34. The control capacitor 34 is configured as a high self-discharge capacitor. This can be achieved, for example, by selecting a suitable material for the insulator of the control capacitor 34. Thus, it is possible to dispense with the control resistor 36.

Figure 4B:
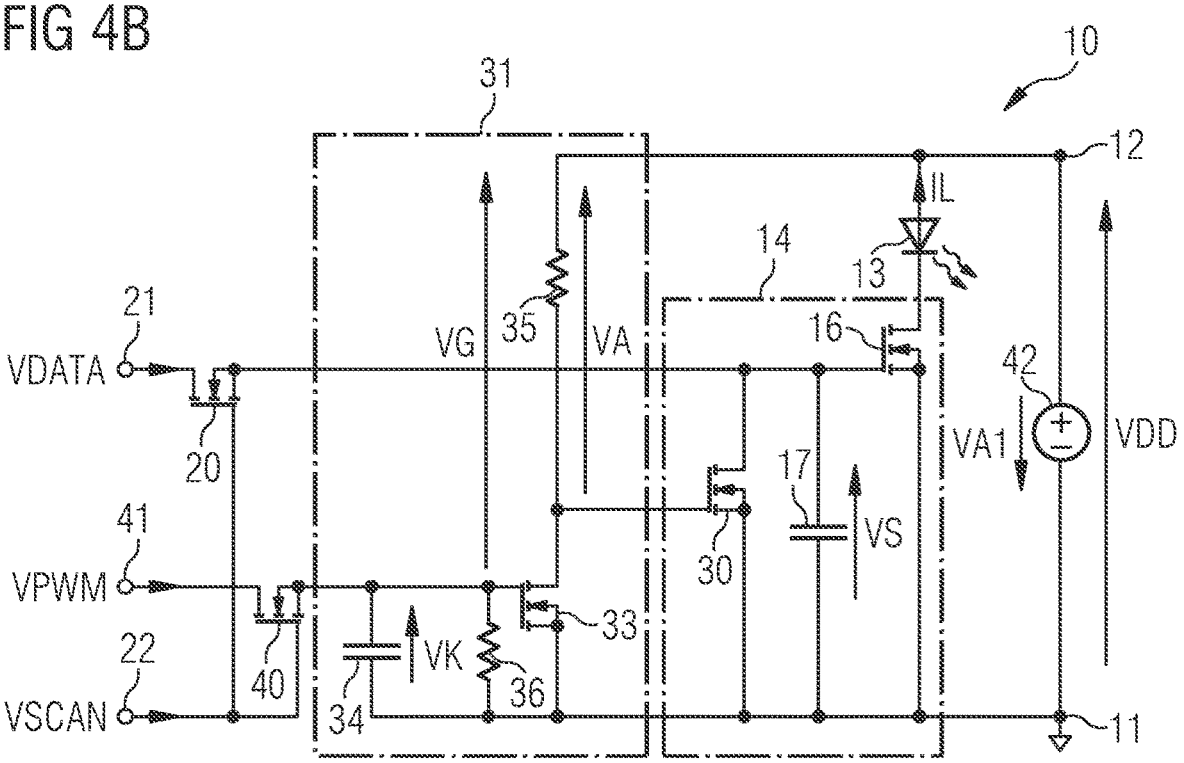

FIG. 4B shows an alternative exemplary embodiment of an image element 10, which is a further development of the embodiments shown above. Here, the transistors such as the driver transistor 16, the switching transistor 30, the output transistor 33, the selection transistor 20 and the control transistor 40 are realized as n-channel field effect transistors. The first supply terminal 11 is realized as a reference potential terminal and the second supply terminal 12 is realized as a voltage supply terminal. The second supply terminal 12 is thus at a higher potential than the first supply terminal 11. A supply voltage VA1 can be tapped at the voltage source, which has the same magnitude as the supply voltage VDD but the opposite sign to the supply voltage VDD. The supply voltage VDD is negative. In contrast to FIGS. 1, 2A and 3A, the voltages and signals here are referenced to the potential of the first supply terminal 11.

The threshold voltage VTH of the above transistors 16, 30, 33, 20, 40 is positive; it can be e.g. 2V. The transistors 16, 30, 33, 20, 40 are self-blocking.

The operation of the image element 10 is similar to that shown in FIGS. 2A and 3A. However, the output transistor 33 is conductive as long as VG>VTH; thereby, the switching transistor 30 is non-conductive.

In one example, the current setting voltage VDATA and the trigger setting voltage VPWM may be voltages referenced to the second supply terminal 12; therefore, for example, some of the above equations may apply. Alternatively, the current setting voltage VDATA and the trigger setting voltage VPWM may be voltages referenced to the first supply terminal 11; therefore, for example, the following equations may apply:

$$VS=-VDATA \text{ or } |VS|=|VDATA|$$

$$VK=-VPWM \text{ or } |VK|=|VPWM|$$

Figure 4C:
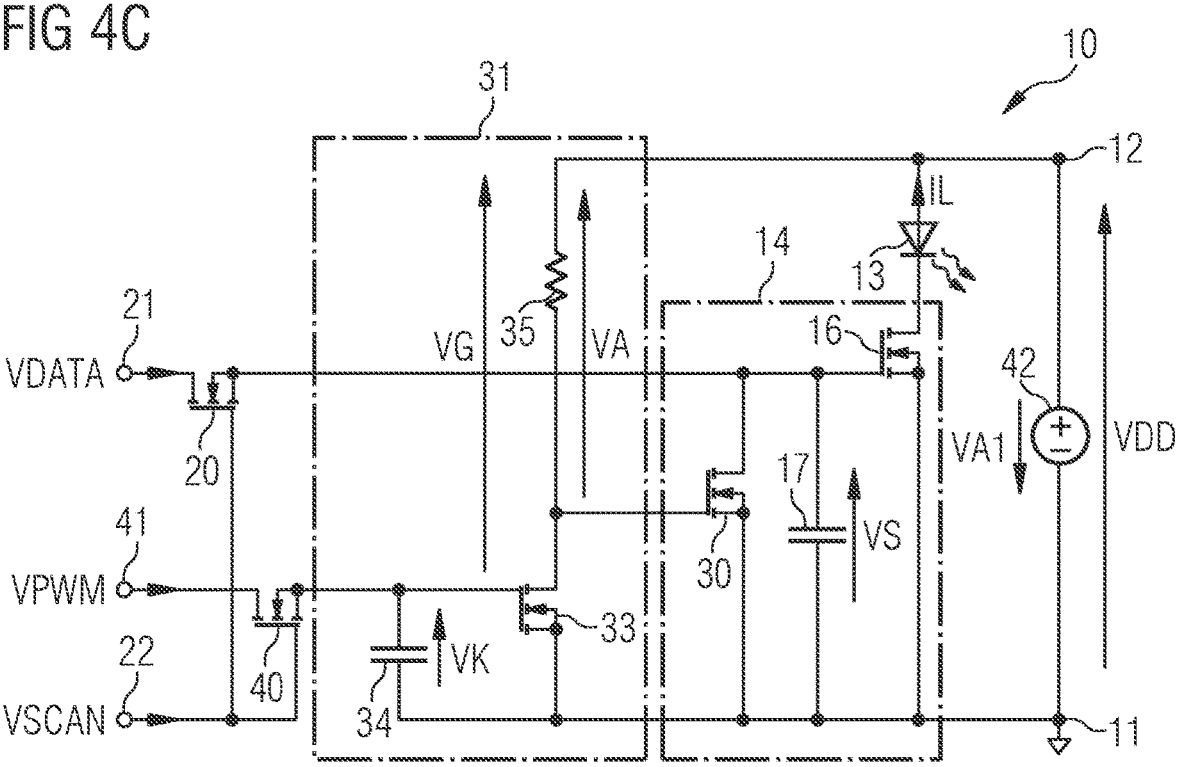

FIG. 4C shows an additional exemplary embodiment of an image element 10 which is a further development of the embodiments shown above. Here, too, the transistors 16, 30, 33, 20, 40 are realized as n-channel field-effect transistors (as also in FIG. 4B). Further, the image element 10 is realized without a control resistor 36 (as also shown in FIG. 4A).

FIG. 5 shows an alternative exemplary embodiment of a detail of an image element 10, which is a further development of the embodiments shown above. The image element 10 comprises the control transistor 40 and the selection transistor 20, as already shown in the above figures. However, in FIG. 5, both the first terminal of the control transistor 40 and the first terminal of the selection transistor 20 are connected to the control signal input 41 of the image element 10. The control terminal of the control transistor 40 is connected to the selection input 22 of the image element 10. On the other hand, the control terminal of the selection transistor 20 is connected to a further selection input 43 of the image element 10. Thus, the image element 10 has two digital inputs, namely a selection input 22 and a further selection input 43, and one analog input, namely the control signal input 41. At a time when the current setting voltage VDATA is applied to the control signal input 41, the selection transistor 20 is rendered conductive. At a further point in time when the trigger setting voltage VPWM is applied to the control signal input 41, the control transistor 40 is switched to conductive by means of a further selection signal VSCAN2. This means that the current setting voltage VDATA and the trigger setting voltage VPWM are supplied one after the other with a time delay.

Figure 6:
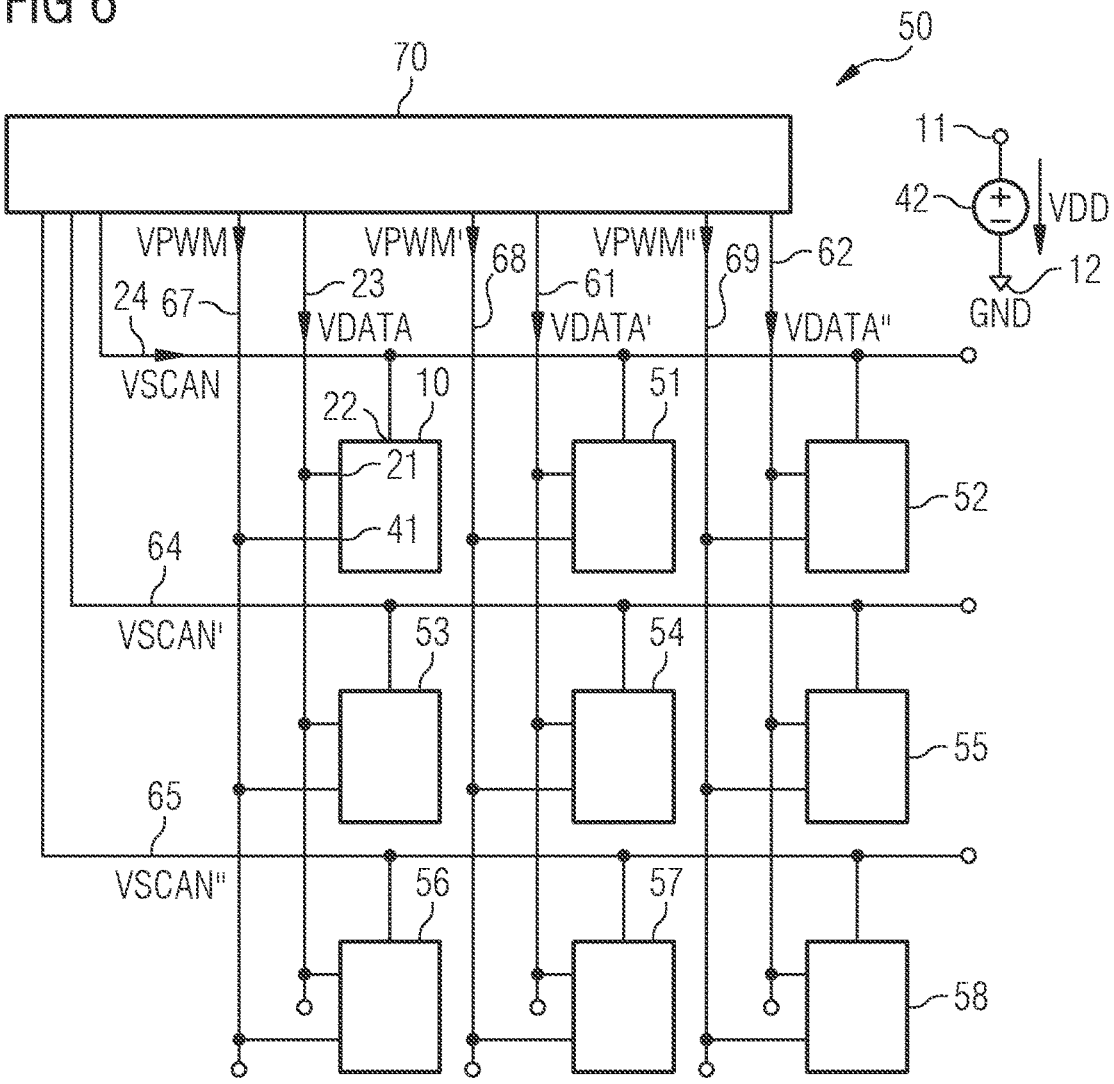
FIG. 6 an exemplary embodiment of a display device.

FIG. 6 shows an exemplary embodiment of a display device 50 with an image element 10, which can be implemented according to the exemplary embodiments shown above. The display device 50 is realized as a display, in particular as an active matrix display. The display device 50 implements an array of image elements 10, 51 to 58. The light emitting semiconductor component 13 (abbreviated as semiconductor component) is produced as a light emitting diode, in particular as a micro light emitting diode, abbreviated as μLED. The μLED may, for example, be made of indium gallium nitride InGaN. The display device 50 comprises a first number N of columns and a second number M of rows. In FIG. 6, the first and the second number N=M=3. The display device 50 thus comprises N×M image elements 10, 51 to 58, which may be realized according to one of the exemplary embodiments shown above.

The display device 50 comprises a first number N of column lines 23, 61, 62 and a second number M of row lines 24, 64, 65. The column lines 23, 61, 62 are each connected to a respective signal input 21 of the image elements 10, 51 to 58 of one of the columns. Accordingly, the row lines 24, 64, 65 are each connected to a respective selection input 22 of the image elements 10, 51 to 58 of one of the rows. Additionally, the display device 50 comprises a first number N of further column lines 67 to 69. The further column lines 67 to 69 are each connected to a respective control signal input 41 of the image elements 10, 51 to 58 of one of the columns. Further, the display device 50 comprises a control device 70 connected to the first number N of column lines 23, 61, 62, the first number N of further column lines 67 to 69 and the second number M of row lines 24, 64, 65. In addition, the display device 50 comprises the voltage source 42 connected to the image elements 10, 51 to 58 via lines not shown.

The control device 70 generates a first number N of current setting voltages VDATA, VDATA', VDATA" and a first number N of trigger setting voltages VPWM, VPWM', VPWM" and provides this to the first number N of column lines 23, 61, 62 and the first number N of further column lines 67 to 69. On a pulse on one of the second number M of row lines 24, 64, 65, the current setting voltages VDATA, VDATA', VDATA" as well as the trigger setting voltages VPWM, VPWM', VPWM" are taken from bit cells 10, 51 to 58 of the selected row.

The invention is not limited to the exemplary embodiments by the description of the invention based on the exemplary embodiments. Rather, the invention comprises any new feature as well as any combination of features, which in particular includes any combination of features in the claims, even if that feature or combination itself is not explicitly recited in the claims or exemplary embodiments.

The invention claimed is:

1. An image element, comprising
- a first and a second supply terminal,
- a light emitting semiconductor component,
- a driver circuit comprising a driver transistor, a storage capacitor and a switching transistor, and
- a trigger circuit comprising an output transistor and a control capacitor, wherein the light emitting semiconductor component and the driver transistor are arranged in series with each other and between the first supply terminal and the second supply terminal, wherein a first electrode of the storage capacitor is coupled to a control terminal of the driver transistor, wherein the switching transistor is configured to switch on and off a current flow through the light emitting semiconductor component, wherein a first electrode of the control capacitor is connected to a control terminal of the output transistor, and wherein a first terminal of the output transistor is connected to a control terminal of the switching transistor.

2. The image element according to claim 1,
- wherein a second electrode of the control capacitor is coupled to the first supply terminal and a second terminal of the output transistor is coupled to the first supply terminal.

3. The image element according to claim 1, wherein the trigger circuit comprises an output resistor coupled to the first terminal of the output transistor and to the second supply terminal.

4. The image element according to claim 1, wherein the trigger circuit comprises a control resistor coupled to the first and second electrodes of the control capacitor.

5. The image element according to claim 1, comprising a control transistor with
- a first terminal coupled to a control signal input of the image element,
- a second terminal coupled to the first electrode of the control capacitor, and
- a control terminal coupled to a selection input of the image element.

6. The image element according to claim 5, comprising a selection transistor with
- a first terminal coupled to a signal input of the image element,
- a second terminal coupled to the first electrode of the storage capacitor, and
- a control terminal coupled to the selection input of the image element.

7. The image element according to claim 5, comprising a selection transistor with
- a first terminal coupled to the control signal input of the image element,
- a second terminal coupled to the first electrode of the storage capacitor, and
- a control terminal coupled to a further selection input of the image element.

8. The image element according to claim 1, wherein a first terminal of the driver transistor is coupled to the first supply terminal, wherein a second electrode of the storage capacitor is coupled to the first supply terminal, and
- wherein the light emitting semiconductor component is coupled to the second terminal of the driver transistor and to the second supply terminal.

9. The image element according to claim 1, wherein the switching transistor couples the first electrode of the storage capacitor to the first supply terminal.

10. The image element according to claim 1, wherein the switching transistor is arranged in series with the light emitting semiconductor component and the driver transistor, such that the light emitting semiconductor component, the switching transistor and the driver transistor are arranged between the first supply terminal and the second supply terminal.

11. The image element according to claim 1, wherein the driver transistor, the switching transistor and the output transistor are produced as thin film transistors.

12. The image element according to claim 1, wherein the driver transistor, the switching transistor and the output transistor are realized as n-channel field effect transistors, or
- the driver transistor, the switching transistor and the output transistor are realized as p-channel field effect transistors.

13. A display device comprising
- a plurality of image elements according to claim 1, which are arranged in rows and columns in a matrix-like manner,
- a plurality of column lines, each connected to a respective signal input of the image elements of one of the columns,
- a plurality of further column lines, each connected to a respective control signal input of the image elements of one of the columns,
- a plurality of row lines each connected to a respective selection input of the image elements of one of the rows, and a control device connected on the output side to the plurality of column lines, the plurality of further column lines and the plurality of row lines.

14. A method for operating an image element, comprising applying a supply voltage between first and second supply terminals, the supply voltage dropping across a series circuit comprising a light emitting semiconductor component and a driver transistor, supplying a current setting voltage to a storage capacitor, wherein a first electrode of the storage capacitor is coupled to a control terminal of the driver transistor, supplying a trigger setting voltage to a control capacitor, wherein a first electrode of the control capacitor is coupled to a control terminal of an output transistor, providing an output signal by the output transistor, and turning on and/or turning off a current flow through the light emitting semiconductor component by a switching transistor controlled by the output signal.

15. The method according to claim 14, wherein a capacitor voltage applied to the control capacitor changes after the trigger setting voltage is applied, such that the value of the output signal is changed and therefore the current flow is either turned on or turned off.

16. The method according to claim 15, wherein the capacitor voltage changes due to self-discharge of the control capacitor after the trigger setting voltage is applied.

17. An image element, comprising a first and a second supply terminal, a light emitting semiconductor component, a driver circuit comprising a driver transistor, a storage capacitor and a switching transistor, and a trigger circuit comprising an output transistor and a control capacitor, wherein the light emitting semiconductor component and the driver transistor are arranged in series with each other and between the first supply terminal and the second supply terminal, wherein a first electrode of the storage capacitor is coupled to a control terminal of the driver transistor, wherein the switching transistor is configured to switch on and off a current flow through the light emitting semiconductor component, wherein a first electrode of the control capacitor is connected to a control terminal of the output transistor, wherein a first terminal of the output transistor is connected to a control terminal of the switching transistor, and wherein the trigger circuit comprises a control resistor coupled to the first and second electrodes of the control capacitor.

* * * * *